US005830043A

United States Patent [19]

Aaron et al.

[11] Patent Number: 5,830,043

[45] Date of Patent: Nov. 3, 1998

[54] CHEMICAL-MECHANICAL POLISHING APPARATUS WITH IN-SITU PAD CONDITIONER

[75] Inventors: Jack Aaron, Tustin; William Yueh, Irvine, both of Calif.

[73] Assignee: IC Mic-Process, Inc., Santa Ana, Calif.

[21] Appl. No.: 840,252

[22] Filed: Apr. 14, 1997

[51] Int. Cl.[6] ..... B24B 21/18

[52] U.S. Cl. ..... 451/72; 451/443; 451/444

[58] Field of Search ..... 451/56, 67, 72, 451/443, 444

[56] References Cited

U.S. PATENT DOCUMENTS 4,525,955 7/1985 Cothrell et al. ..... 451/444 X
4,712,334 12/1987 Ikezaki et al. ..... 451/444
5,154,021 10/1992 Bombardier et al. ..... 451/444
5,738,573 4/1998 Yueh ..... 451/287

*Primary Examiner*—Timothy V. Eley
*Attorney, Agent, or Firm*—Herbert M. Shapiro

[57] ABSTRACT

Chemical-mechanical polishing apparatus includes a pad reconditioning mechanism which comprises nested conical tubes which overly the pad. The outer tube has an array of holes in it much like the head of an electric razor and is rotated about its axis by being in contact with the rotating pad. The inner cone is stationary and has a longitudinal, downward-facing slot. An air stream from the narrow end of the inner cone towards the wide end carries particle-laden slurry to the wide end for removal or recycling. The nested cones are arranged like a detachable bridge with the narrow end secured to a non-rotating center core and the wide end secured to the top of the table in which the (now annular) platen rotates.

14 Claims, 2 Drawing Sheets

CHEMICAL-MECHANICAL POLISHING APPARATUS WITH IN-SITU PAD CONDITIONER

FIELD OF THE INVENTION

This invention relates to chemical-mechanical polishing (CMP) apparatus and, more particularly, to apparatus where a wafer is polished by being placed against a platen which has a pad as the polishing surface.

BACKGROUND OF THE INVENTION

CMP apparatus is in widespread use. Characteristic of such equipment is a circular platen with a polishing pad affixed to the top surface. A wafer carrier, holding a wafer in place typically by vacuum, is juxtaposed against the pad. A slurry is introduced onto the pad and both the platen and the wafer carrier are rotated about respective axis for polishing the wafer surface much in the manner of polishing glass.

The polishing process results in particles being removed from the wafer surface. These particles fill the pores of the pad and cause a "glazing" effect resulting in slowing the particle removal rate. It is important to remove these particles from the platen to avoid reducing the effectiveness of the polishing process. Copending application Ser. no. 08/833,444 filed Apr. 7, 1997 discloses a slurry recovery technique which eliminates such particles and recycles the slurry. That technique captures used slurry at the periphery of the platen and employs an end-of-process control to regulate the recycling process.

BRIEF DESCRIPTION OF AN ILLUSTRATIVE EMBODIMENT OF THIS INVENTION

In accordance with the principles of this invention, conical-shaped cylinders overlie the rotating platen and pad. The cylinders are arranged one inside the other. The interior cylinder is stationary and has a longitudinal slot along the periphery of the cone facing the pad. The outer cone is rotated by the moving platen with which it is in contact. Also, the rotating outer cone has an array of holes, much like the face of an electric shaver. Particles generated by the polishing action pass through the holes in the rotating outer cone and enter the slot in the interior cone.

A stream of clean air is introduced at the narrow end of the inner cone and a vacuum suction is maintained at the wide end of the inner cone. Particle containing slurry accordingly is moved along the inner cone to be collected by a tube connected to the wide end of the inner cone for recycling or disposal.

Copending application Ser. No. 08/789,840 filed Jan. 24, 1997 for the assignee of the present invention discloses a CMP apparatus where the platen is annular-shaped and rotating about a non-rotating center core. In one embodiment herein, the narrow end of the nested cone arrangement herein is coupled on bearings to the center core. The wide end of the nested cones is coupled to the table (top) in which the platen rotates. The nested cone arrangement thus bridges the platen and is operative to depress and reactivate the fibers of the pad and recover the slurry and particles for recycling or removal. The apparatus is totally seated on both end structures to prevent any contamination in the CMP apparatus and can thus be used as an in-situ, on-line device during the polishing cycle.

DETAILED DESCRIPTION OF AN ILLUSTRATIVE EMBODIMENT OF THIS INVENTION

Figure 1:
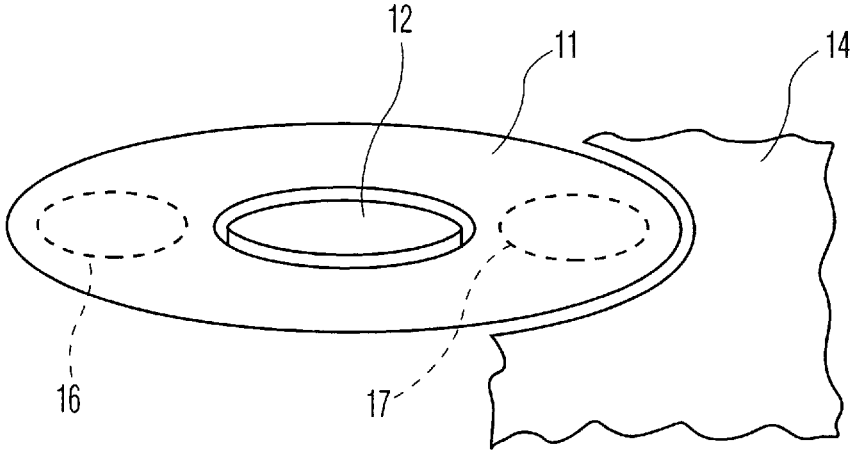
FIG. 1 is a schematic top view of a CMP apparatus having a non rotating center core.

FIG. 1 shows an annular-shaped platen 11 which has a non rotating central core 12. The platen rotates in a plane coplanar with the top surface 14 of a table supporting the apparatus. The positions of wafer carriers which hold wafers against the (pad covered) platen are indicated by broken circles 16 and 17.

Figure 2:
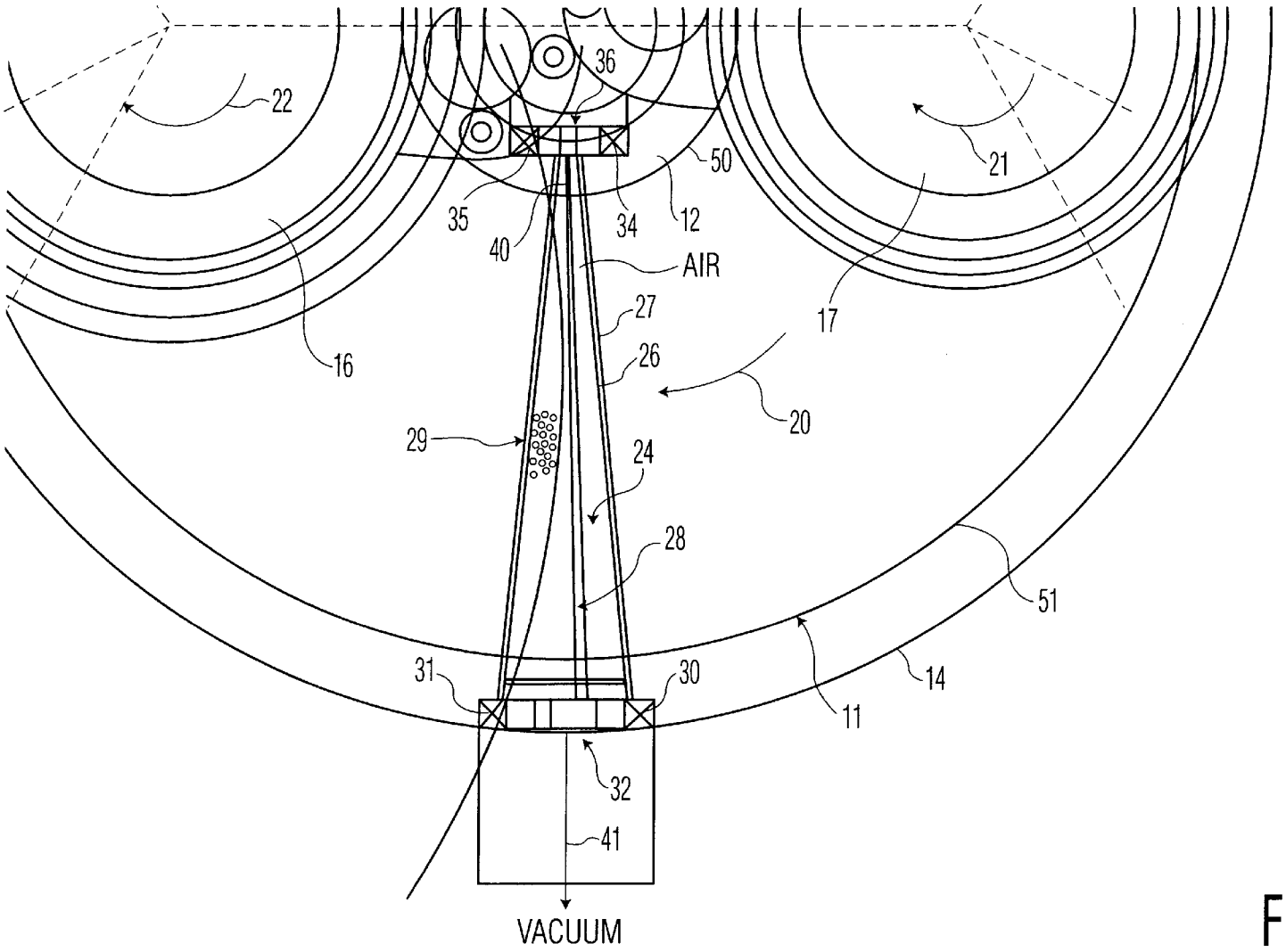
FIG. 2 is a schematic top view of a portion of the apparatus of FIG. 1 showing the nested cone pad conditioner in accordance with the principles of this invention.

FIG. 2 is a schematic top view of a portion of the apparatus of FIG. 1 again showing the platen 11, center core 12, and positions 16 and 17 of juxtaposed wafer carrier. The platen and the wafer carrier are shown as rotating clockwise as indicated by curved arrows 20, 21, and 22.

FIG. 2 also shows a conical-shaped member 24 extending from center core 12 to table 14. Member 24 includes a cone 26 within a cone 27. Cone 26 is stationary (non rotating). Cone 27 is rotated about the axis thereof by being in contact with the pad on platen 11.

Cone 26 has a downward facing slot 28 and cone 27 has random holes in its periphery much as does the cover of an electric razor as indicated at 29. The nested cones are set on bearings 30 and 31 at the wide end 32 and 34 and 35 at the narrow end 36. The bearings permit cone 27 to rotate while cone 26 is non-rotating.

End 36 of cylinder 26 is connected to an air supply as indicated by arrow 40. End 32 of cone 26 is connected to a vacuum hose as indicated by arrow 41. The nested tube assembly is operative to depress the nap of the pad covering the platen and to attract slurry and particles through the apertures in the cone.

The particles and slurry which pass through apertures 29 are drawn through slot 28 and carried by the air flow in cylinder 26 to the wide end of cone 26 into a tube (not shown) much as a vacuum cleaner moves dust particles to a bin for disposal. But the slurry may be collected, cleaned and recycled as noted hereinbefore.

Figure 3:
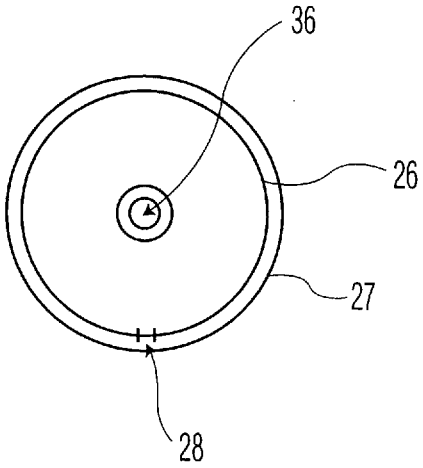
FIG. 3 is a schematic end view of the nested cones of FIG. 2.

FIG. 3 is an end view of wide end 32 of the nested cone arrangement. The figure shows inner cone 26, outer cone 27 and downward facing slot 28. The narrow end 36 is also shown.

Holes 29 and slot 28 are just sufficiently large to permit particles to pass. Typically, the holes are one to five microns in diameter and the slot has a width of like dimensions.

The cone shape is required because of the difference in the distance traversed by the rotating cone at narrow end 26 and the much larger distance traversed by the (rotating) cone at the periphery of the platen. That is to say, the inner periphery 50 of the annular-shaped platen and the outer periphery 51 are whole number multiples of the peripheries of the narrow end and the wide end, respectively, of outer cone 27.

The nested cone assembly occupies the position of a bridge which spans the (annular-shaped) platen. The assembly is removable from the central core and the table to which it is connected in order to change the pad.

The outer cone may be motorized to rotate in a direction opposite to that of the pad. The "counter rotating" movement of the outer cone maximizes the particle removal process and pad rejuvenation action.

For the conventional CMP apparatus that does not have a non-rotating center core, a pad conditioner, in accordance with the principles of this invention, includes a bridge over the entire (circular) platen with the "cones" having the shapes of cylinders each with the same diameter at both ends.

What is claimed is:

1. Chemical-mechanical polishing apparatus having a platen rotatable in a plane about a center axis, said apparatus including an in-situ pad reconditioning means for extracting slurry and particles from said pad, said means comprising an inner and an outer cylinder each having first and second ends, said inner cylinder being nested within said outer cylinder and having a common axis therewith, said outer cylinder having an array of holes thereabout and being rotatable about said common axis in response to the rotation of said platen, said inner cylinder being stationary and having a downward facing, longitudinal slot, said first and second ends of said inner cylinder being movably coupled to said apparatus.

2. Apparatus as in claim 1 wherein said platen has an annular shape and is rotatable about a non-rotating center core.

3. Apparatus as in claim 2 wherein each of said inner and outer cylinders is a cone and a first end narrower than the second end thereof.

4. Apparatus as in claim 3 wherein said second end of said inner cone is connected to a means for creating a vacuum.

5. Apparatus as in claim 3 wherein said first end of said inner cone is connected to an air supply.

6. Apparatus as in claim 5 wherein said second end of said inner cone is connected to a means for creating a vacuum.

7. Apparatus as in claim 6 wherein said outer cone is rotatably coupled to said inner cone.

8. Apparatus as in claim 3 wherein the inner periphery of said annular shaped platen and the outer periphery thereof are whole number multiples of the periphery of said outer cone at said narrow end and the periphery of said outer cone at said wide end respectively, measured at the very ends thereof.

9. Apparatus as in claim 1 wherein said second end of said inner cylinder is connected to a means for creating a vacuum.

10. Apparatus as in claim 1 wherein said first end of said inner cylinder is connected to an air supply.

11. Apparatus as in claim 1 wherein said outer cylinder is rotatably coupled to said inner cylinder.

12. Pad reconditioning means for extracting slurry and particles from a pad of a chemical-mechanical polishing apparatus, said means comprising inner and outer cones, said inner cone being nested within said outer cone and having a common axis therewith, said outer cone being rotatable about said common axis with respect to said inner cone, said inner cone having a longitudinal, downward facing slot, said outer cone having an array of apertures therein.

13. Apparatus as in claim 12 including means for rotating said outer cone.

14. Apparatus as in claim 13 wherein said means for rotating is said platen, said outer cone being in contact with said platen.

* * * * *